US006753750B1

(12) United States Patent
Posadas-Sánchez

(10) Patent No.: US 6,753,750 B1
(45) Date of Patent: Jun. 22, 2004

(54) 1.2 KV CLASS PORCELAIN BUSHING WITHSTANDING 45 KV STANDARD LIGHTING IMPULSE VOLTAGE

(75) Inventor: Daniel Posadas-Sánchez, Nuevo León (MX)

(73) Assignee: Prolec, S.A. de C.V., Apodaca (MX)

( * ) Notice: Subject to any disclaimer, the term of this patent is extended or adjusted under 35 U.S.C. 154(b) by 0 days.

(21) Appl. No.: 10/457,572

(22) Filed: Jun. 9, 2003

(51) Int. Cl.[7] ..... H01F 38/20; H01B 17/26
(52) U.S. Cl. ..... 336/107; 336/173; 174/142
(58) Field of Search ..... 336/107, 173; 174/142, 152 R, DIG. 10

(56) References Cited

U.S. PATENT DOCUMENTS

| | | | | |
|---|---|---|---|---|
| 4,016,359 A | | 4/1977 | Gamble | |
| 4,477,692 A | | 10/1984 | Brealey | |
| 4,670,625 A | | 6/1987 | Wood et al. | |
| 4,760,216 A | * | 7/1988 | Thiel et al. | 174/142 |
| 4,818,967 A | | 4/1989 | Mikulecky | |
| 4,847,450 A | | 7/1989 | Rupprecht | |
| 4,965,407 A | | 10/1990 | Hamm | |
| 4,985,599 A | | 1/1991 | Eggleston | |
| 5,153,383 A | | 10/1992 | Whited et al. | |
| 5,281,767 A | | 1/1994 | West et al. | |
| 6,140,573 A | | 10/2000 | Smith et al. | |
| 6,452,109 B1 | | 9/2002 | Koch et al. | |
| 6,466,425 B1 | | 10/2002 | Shirakawa et al. | |
| 2002/0021200 A1 | * | 2/2002 | Owen | 336/173 |
| 2002/0040806 A1 | * | 4/2002 | Baker et al. | 174/142 |

FOREIGN PATENT DOCUMENTS

JP 1-281617 * 11/1989

* cited by examiner

*Primary Examiner*—Chau N. Nguyen
(74) *Attorney, Agent, or Firm*—Harrison & Egbert

(57) ABSTRACT

A porcelain bushing for transformers withstanding impulse voltages rated at 45 kV and 1.2/50 $\mu$s without external flashover, having a creepage to arcing distance ratio of 1.05 to 1.24. The bushing includes a body constituted by a flange fitted with a gasket seat groove, a neck having a curvature radius ranging from 5 to 7 mm, and a mouth equipped with a two-level stepped gasket seat and a semicircular groove. A threaded shank for the attachment of the porcelain bushing to the mounting surface and a groove rail extending along the shank's thread is also provided. In a preferred embodiment, the body is coated with glassy enamel in order to protect the porcelain material against contamination by external agents as well as against the adoption of water.

5 Claims, 3 Drawing Sheets

1.2 KV CLASS PORCELAIN BUSHING WITHSTANDING 45 KV STANDARD LIGHTING IMPULSE VOLTAGE

RELATED U.S. APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

FIELD OF THE INVENTION

This invention relates to a porcelain bushing for transformers and, more particularly, relates to means for improving the ability of such a bushing to withstand lightning impulse voltages rated at 45 kV and 1.2/50 $\mu$s form without external flashover or puncture.

BACKGROUND OF THE INVENTION

A bushing is a device that enables one or several conductors to pass through a partition such as a wall or a transformer tank, and insulates the conductor from it. Bushings commonly comprise an insulating bracket, a conductor, and provision for mounting the bracket to the transformer to insulate the conductor from the transformer surface. The bushings are used to hold the electrical conductors and transfer current from outside of the transformer to coils on the inside of the transformer without shorting out on the transformer surface.

Bushings are rated on how well they insulate the transformer wall from current flowing through the conductor. One factor that must be considered in the rating of bushing terminals is the presence of contaminants the bushing. Contaminants on the bushing provide a conductive path, which can cause electricity to leak out onto the transformer wall and cause electrical arcing or striking. Arcing occurs when the difference in potential between the transformer wall and the conductor becomes sufficiently large. The air ionizes between the transformer wall and the conductor, and this creates a path of relatively low resistance through which current can flow. The resulting blast of electricity can cause a short circuit to occur and severely damage the transformer.

Another factor used to rate bushings is electrical "creepage" across the insulating bracket. Creepage is the electrical leakage on a solid dielectric surface. Creepage distance is the shortest distance on a dielectric surface between two conductive elements. The current will essentially track or crawl across the insulating bracket onto the transformer wall. The onset of creepage can produce similar effects to contamination in that a short circuit to the transformer wall can occur and cause damage to the transformer itself.

One solution utilized to minimize these problems is the use of a material with a high insulating property such as porcelain to create the bushing. However, porcelain is not durable and is easily broken. A broken or damaged bushing requires costly replacement and down time of the transformer. Utilization of Ex-Mount bushing a t a higher voltage will result in higher incidents of arcing, striking, or creepage across the insulating bracket. The following are patents related to transformer bushings.

Shirakawa, et al. in the U.S. Pat. No. 6,466,425 provided an arrester excellent in a limit voltage characteristics which can withstand a contamination phenomenon of a porcelain bushing surface, and a surge absorption. Metal plates each having a thickness greater than a zinc oxide element portion does using high withstand voltage zinc oxide elements are arranged to suppress a rise in temperature of the zinc oxide elements. By employing the above means, it is possible to realize an arrester capable of suppressing a rise in temperature of the zinc oxide elements and which is low in a limit voltage and has higher performance.

Smith, et al. in the U.S. Pat. No. 6,140,573 disclosed an improved hollow core composite bushing for use in, for example, a dead tank circuit breaker, is smaller and lighter and offers other advantages over previous designs. The hollow core bushing includes therein a fiber reinforced plastic (FRP) elongated tube that operates to increase the dielectric constant between a conductor and a transition shield. By placing the transition shield external to the hollow core bushing and providing the FRP tube between the conductor and transition shield, the dielectric constant between the shield and conductor is increased thus allowing the inner diameter of the shield and outer diameter of the bushing to be decreased. In addition, the transition shield may be an integral part of the flange that is mounted to the bushing current transformer support column or interrupter enclosure of the dead tank circuit breaker thus further reducing the diameter and overall size of the bushing. Further, the transition shield maybe an integral part of the FRP tube.

Whited, et al. in the U.S. Pat. No. 5,153,383 disclosed a flexible sheet of material for mounting about a vertical or horizontal type porcelain insulator of electrical equipment to physically protect the insulator from falling objects during maintenance when the electrical equipment is de-energized. The sheet is formed of flexible PVC material and is foldable into a conical configuration and secured about the insulator by VELCRO strips attached to the sheet. Additional rectangularly-shaped sheets of similar material also are provided with VELCRO fasteners are formed into a cylindrical configuration and placed around the insulator and secured to the conically wrapped sheet to provide physical protector for taller porcelain insulators.

Eggleston in the U.S. Pat. No. 4,985,599 disclosed a bushing cap provided for mounting to a transformer bushing or to a lightening arrestor. The bushing cap when mounted to the bushing acts as an umbrella for the bushing to protect the same from airborne contaminates such as salt spray which can form a conductive surface on the bushing, while providing adequate bottom and side clearance from the bushing to ensure that a conductive surface between the cap and the bushing is avoided.

Thiel, et al, in the U.S. Pat. No. 4,760,216, disclosed a method for making an electrical bushing having an enlarged intermediate portion and reduced portions at opposite ends. The method is characterized by the steps of mounting an annular flange around one of the reduced portions to form a peripheral gutter adjacent to the one portion, mounting a cap on the other of the reduced portions to form a peripheral gutter adjacent to the other portion, placing a solid solder ring in each gutter, and with the open sides of the gutters upright, heating the solder rings to a molten temperature and cooling the molten solder to below its melting temperature in order to provide a joint between the flange and the one portion and the cap and the other portion.

Wood, et al. in the U.S. Pat. No. 4,670,625 disclosed a bushing arrangement for conveying an electrical conductor through the casing of high voltage electrical apparatus exposed to the weather comprises a rigid member of synthetic resin cast around, so as to be bonded in a gas tight manner to, the conductor, and incorporating an exterior portion protruding outside the casing, the member being enclosed, over at least the major part of its exterior portion, by a plurality of insulting axially-overlapping weather-resistant collars and a stress cone each having a creepage flange or shed, the member being secured to the casing by a flanged collar. The insulating member may be made of a relatively cheap non-weather-resistant epoxy resin and the collars of EPDM rubber.

Gamble in the U.S. Pat. No. 4,016,359 disclosed an insulating bushing assembly for use with electrical apparatus and adapted to be installed through an aperture in a wall thereof, characterized by an electrically insulating bushing extending through an aperture in the wall and sealed in place by an elastic gasket between the bushing and the wall on one side thereof, the bushing having an annular groove on the other side of the wall and a garter spring disposed in the groove and having a smaller portion thereof extending beyond the groove and in contact with the other side of the wall, whereby the elastic gasket is retained in fluid-tight compression between the bushing and the wall.

West, et al. in the U.S. Pat. No. 5,281,767 disclosed an improved, failure-resistant, low mechanical stress electrical connector bushing is provided which includes an elongated, central metallic conductor rod with an insulative epoxy body cast about the central rod. The rod is of substantially constant diameter throughout its length, and includes a male connection end and an opposed female connection end. The connection end presents an upset, integral, cold-forged, radially expanded terminal portion having a diameter greater than the constant diameter rod, and presents a butt end face. Stress analysis confirms that the bushing develops reduced, mechanical thermally induced stresses, as compared with a prior design.

Hamm in the U.S. Pat. No. 4,965,407 disclosed a bushing system for high voltage electrical equipment includes a weathershed with integral annular shirts molded around an electrical conductor. The weathershed has a cavity at its flange for mating with the opening in the housing for the high voltage electrical equipment. A dielectric gas in the housing communicates with the cavity in the weathershed. A flange and seal are provided at the flange of the weathershed for sealingly connecting the bushing system to the housing. A secondary ground may also be provided Rupprecht, in the U.S. Pat. No. 4,847,450 disclosed a high voltage bushing formed from a plurality of insulating layers. Conductive layers are interleaved with the insulating layers, and are electrically insulated from each other. The ends of the conductive layers are overlapped by stress grading layers, to minimize the electrical stress on the bushing.

Mikulecky in the U.S. Pat. No. 4,818,967 disclosed a current limiting fuse for a transformer bushing including a glass tubing, an elongate ribbon spirally wound in the tubing, the ribbon including a number of tabs formed integral therewith to space the ribbon inwardly of the walls of the tubing, a terminal stud mounted on one end of the tubing and being electrically connected to the ribbon, a conductive rod connected to the other end of the ribbon and sealed in the other end of the tubing, a granular dielectric material completely filling the tubing, a self-sealing, self-bonding, rubber tape wrapped around the outside of the tubing and a glass reinforced tape wrapped around the outside of the rubber tape.

Brealey in the U.S. Pat. No. 4,477,692 disclosed a high-voltage terminal bushing comprising a tubular shell of electrical insulating material having a passageway extending between its ends and an electrical conductor within the passageway that has an external surface spaced from the internal surface of the passageway. The external surface of the conductor is covered with a thin coating of insulating material spaced from the internal surface of the passageway by a cylindrical air gap. The coating has sufficient dielectric strength to prevent any corona streamers from the conductor from impinging against said internal surface at impulse voltages up to the rated impulse insulation level of the bushing.

Koch, et al. in the U.S. Pat. No. 6,452,109 disclosed a bushing for a high electric voltage has a casing through which a central conductor is passed so that it is electrically insulated. Conducting liners spaced a distance apart are arranged concentrically around the central conductor, a combination which functions as a dielectric and is composed of one layer of film and one layer of a non-woven film being provided between the liners. The film and the nonwoven material are each made of plastic, so their water content is very low, and therefore the drying time in manufacturing of the bushing is shortened.

Therefore, the present invention recognizes that a need still exists for a durable, cost effective method for reducing the external creepage and incidents of arcing when using bushings rated at 45 W and 1.2/50 $\mu$s without external flashover.

BRIEF SUMMARY OF THE INVENTION

It is therefore one object of the present invention to increase the basic lightning impulse level of 1.2 kV class bushing from 30 kV to 45 kV.

It is another object of the present invention to decrease the external creepage and incidents of arcing when using bushings rated at 45 kV and 1.2/50 $\mu$s without external flashover.

To exceed a minimum standard mechanical strength of 1000N for a cantilever load together with a reduction in size and weight with respect to other commercially available bushings withstanding a lightning impulse voltage of 30 kV.

The foregoing objects are achieved as is now described. The low-voltage porcelain bushing according to the present invention consists of a body and a shank. The body is constituted by a flange, a neck and a mouth. The body and the shank provide the main dielectric capabilities to the porcelain insulator and are designed to withstand 45 W standard lightning impulse voltage with a 1.2/50 $\mu$s form, without being punctured or giving rise to a flaming arc. The body and the shank are also designed to operate under the maximum efficient tension generated between the metallic conductor and the mounting clamp, normally connected to earth.

The body is coated with glassy enamel in order to protect the porcelain material against contamination by external agents as well as against the absorption of water.

The geometry and dimensions of the body determine the withstanding level of the porcelain bushing to the lightning impulse voltage by establishing particular values for the creepage distance (shortest distance along the surface of an insulator between two conductive parts) as well as for the arcing distance (shortest distance in air external to the insulator between metallic parts which normally have the operating voltage between them).

The main feature of the bushing's body of the present invention is the curvature radius of the neck. This curvature radius is such that allows the bushing to withstand lightning impulse voltages rated at 45 kV and 1.2/50 μs form without external flashover or puncture. The curvature radius of the neck defines the creepage to arcing distance ratio. Extensive experimental testing carried out during the development of the present invention showed that the best performance of the bushing was achieved for curvature radii of the neck ranging from 5 to 7 mm. These curvature radii defined creepage to arcing distance ratios from 1.05 to 1.24, which correspond to one of the best electrical performance for the commercially available bushings.

An additional feature of the isolator body is the definition of a minimum curvature radius of 1.5 mm at the joints formed between the neck and both mouth and flange.

The above features, and advantages of the present invention will be best explained in the following detailed written description.

BRIEF DESCRIPTION OF THE VIEW OF THE DRAWING

DETAILED DESCRIPTION OF THE INVENTION

Figure 1:
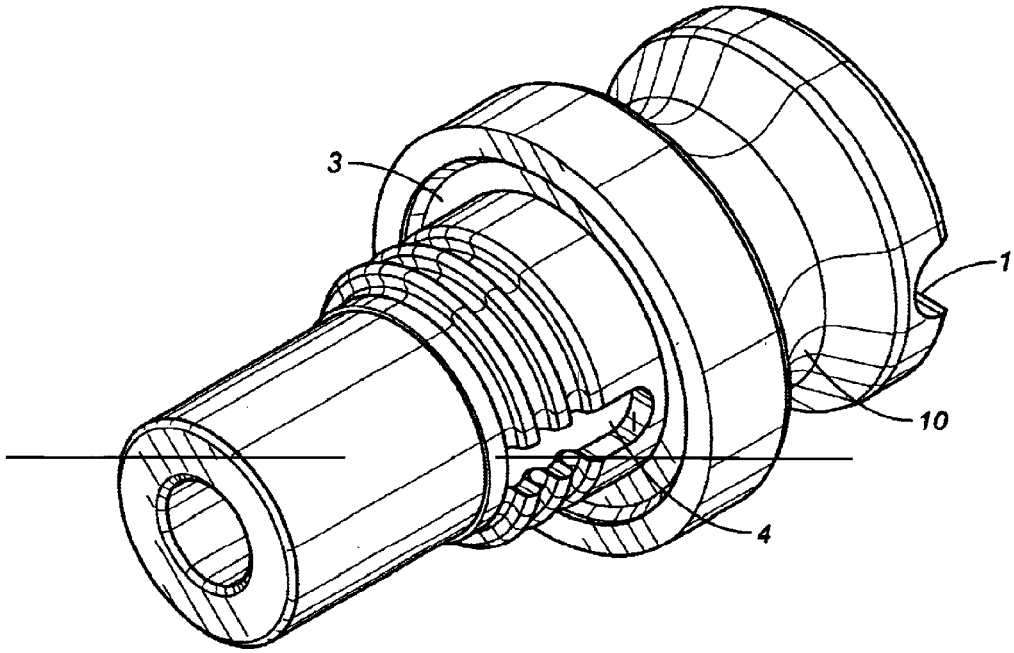
FIG. 1 is an isometric perspective view of an embodiment of the low-voltage porcelain bushing according to the present invention.
Figure 2:
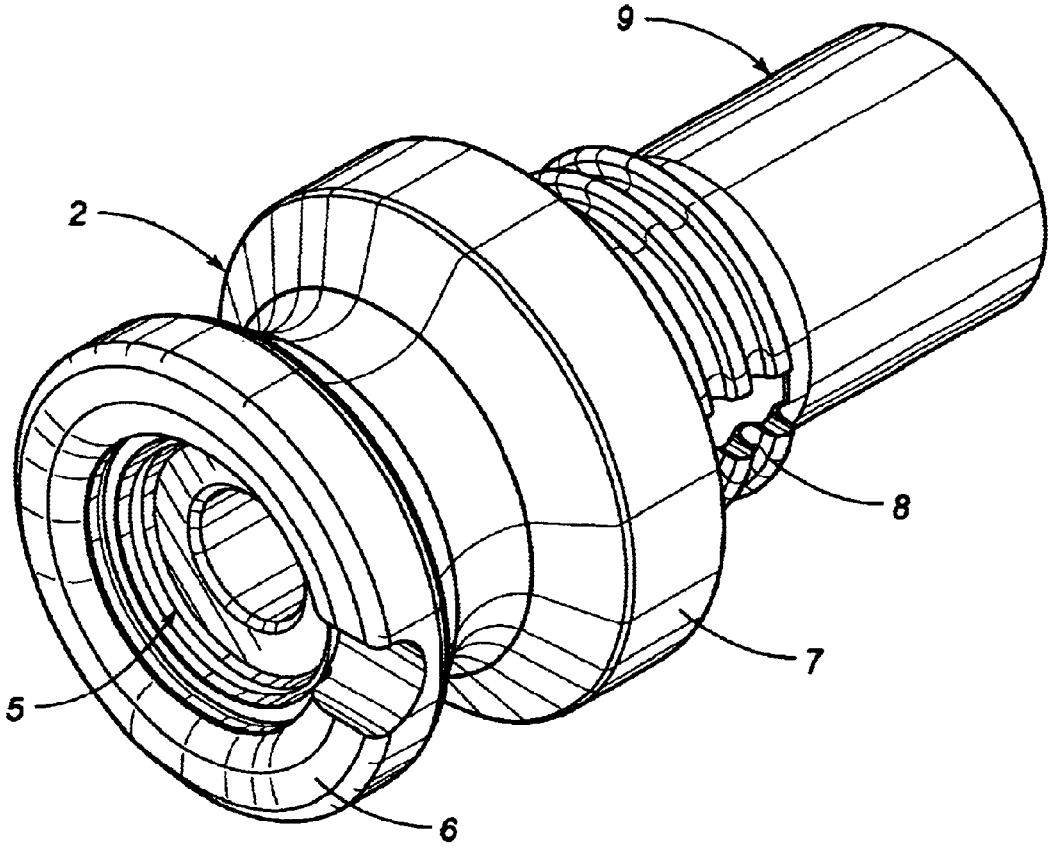
FIG. 2 is another perspective view of the embodiment shown in FIG. 1.
Figure 3:
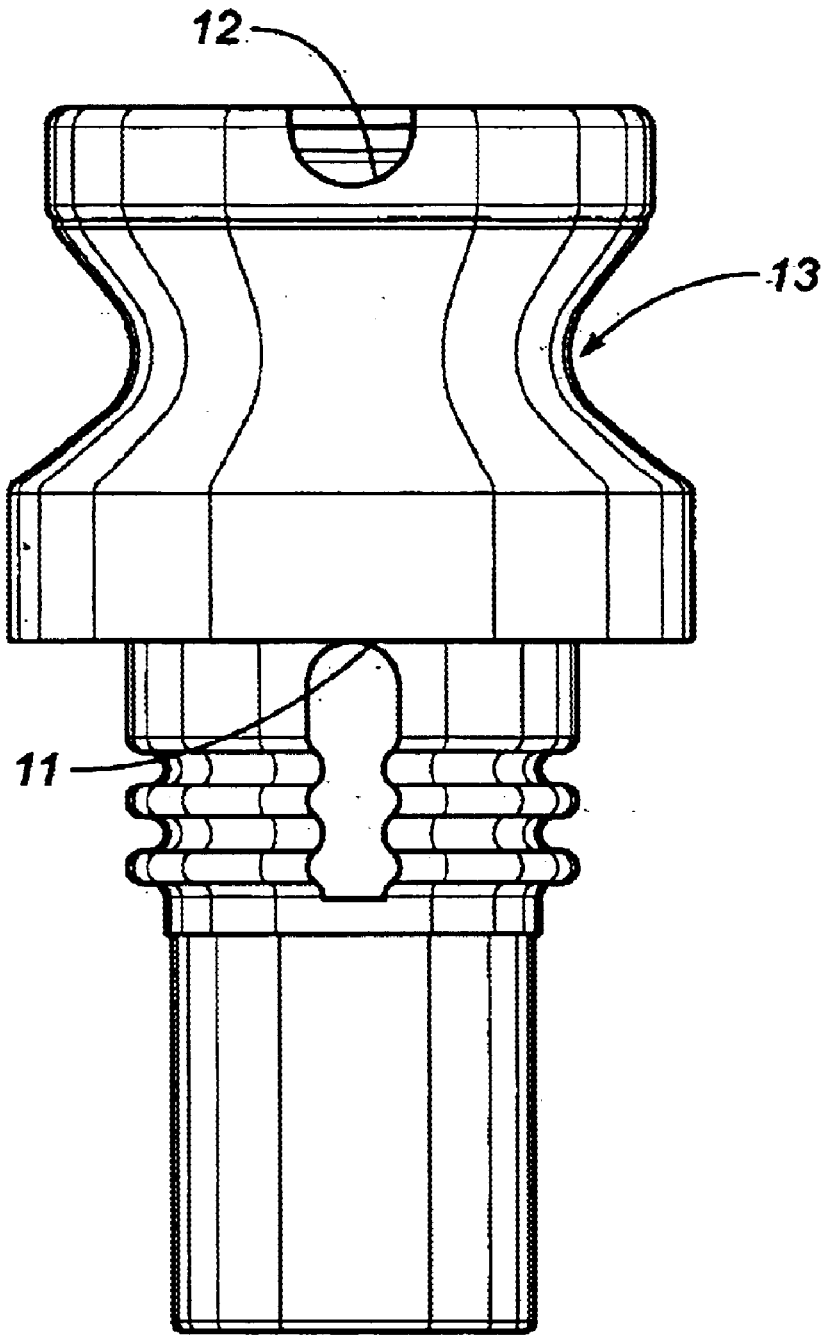
FIG. 3 is another perspective view of the embodiment shown in FIG. 1.

The low-voltage porcelain bushing according to the present invention is best understood by reference to the drawings shown in FIG. 1, FIG. 2 and FIG. 3. According to FIG. 1, the low-voltage porcelain bushing consists of a body 2 and a shank 9. The body 2 is constituted by a flange 7, a neck 10 and a mouth 6. The body 2 and the shank 9 provide the main dielectric capabilities to the porcelain insulator and are designed to withstand a 45 kV full lightning impulse voltage with a 1.2/50 μs form, without being perforated or giving rise to a flaming arc. The body 2 and the shank 9 are also designed to operate under the maximum efficient tension generated between the metallic conductor (not shown) and the mounting clamp (not shown), normally connected to earth.

The body 2 is coated with a glassy enamel (not shown) in order to protect the porcelain material against contamination by external agents as well as against the absorption of water.

At the flange 7, there is a gasket seat groove 3 especially designed to contain a gasket (not shown) for the fitting of the porcelain bushing to the mounting surface (not shown). The flange 7 provides support to the porcelain bushing at the moment of its fitting to the mounting surface (not shown).

The shank 9 is the part of the porcelain bushing that remains submerged in oil inside the transformer tank (not shown). The shank 9 also gives support to an external metallic fitting that conducts the electrical energy by means of a nut an a washer (not shown). The wall thickness of the shank 9 is dimensioned according to the electrical insulation level required as well as according to the impulse tension generated between the metallic conductor (not shown) and the mounting clamp (not shown).

At the shank 9, next to flange 7, there is a thread 8 for the attachment of the porcelain bushing to the mounting surface (not shown). At the shank 9 there is a groove rail 4 that starts at the flange 7, extending through the thread 8. The groove rail 4 has a double function: a) acts as a directional guide for the porcelain bushing at the moment of its assembly with the metallic conductor (not shown), and b) avoids the rotation of the porcelain bushing during its attachment to the mounting surface (not shown).

The mouth 6 is an integral part of the body 2. At the mouth 6 there is a two-level stepped gasket seat 5 that allows fining the porcelain bushing to a metallic connector (not shown). At the mouth 6 there is also a semicircular groove I whose functions are to orientate the metallic connector (not shown) at the moment of its assembly with the porcelain bushing and to avoid the rotation of said metallic connector (not shown) when a torsion pair is applied during attachment of the porcelain bushing to the mounting surface (not shown).

The geometry and dimensions of the body 2 determine the withstanding level of the porcelain bushing to the impulse tension by establishing particular values for the creepage distance (shortest distance along the surface of an insulator between two conductive parts) as well as for the arcing distance (shortest distance in air external to the insulator between metallic parts which normally have the operating voltage between them).

Referring to FIG. 3, for the porcelain bushing of the present invention the creepage distance is measured along the surface of the porcelain bushing between point 11 located at the base of flange 7 and point 12 located at the lower point of the semicircular groove 1. Thus, the creepage distance depends upon the radius of curvature of the neck 10.

Referring again to FIG. 3, the arcing distance corresponds to the shortest linear distance in air measured between point 11 located at the base of flange 7 and point 12 located at the lower point of the semicircular groove 1.

The main feature of the bushing's body of the present invention is the curvature radius of the neck. This curvature radius is such that allows the bushing to withstand lightning impulse voltages rated at 45 kV and 1.2/50 μs form without external flashover or puncture. The curvature radius of the neck defines the creepage to arcing distance ratio. Extensive experimental testing carried out during the development of the present invention showed that the best performance of the bushing was achieved for curvature radii of the neck ranging from 5 to 7 mm. These curvature radii defined creepage to arcing distance ratios from 1.05 to 1.24, which correspond to one of the best electrical performance for the commercially available bushings. An additional feature of the isolator body is the definition of a minimum curvature radius of 1.5 mm at the joints formed between the neck and both mouth and flange.

This was determined by means of rated phase-to-earth voltage and Lightning Impulse Withstand tests. Wet Withstand Voltage and Lightning Impulse Critical Flashover Voltage tests were carried out in accordance with the European IEC 137 standard test.

Additional advantages of the porcelain bushings of the present invention consist in a tested capacity to exceed a minimum standard mechanical strength of 1000N for a cantilever load, with a reduction in size and weight with respect to other commercially available bushings.

The properties obtained with the bushings manufactured according to the present invention can be seen by examining the test results described in the following examples.

EXAMPLE 1

Lightning Impulse Withstand Test

The bushing was subjected to the successive application of 15 full waves of lightning impulses with positive polarity followed by 15 full waves of lightning impulses with negative polarity with a standard form of 1.2/50 μs. The voltage wave forms were registered for each one of the lightning impulses applied. It is considered that the bushing has a withstanding level corresponding to the lightning impulses applied because punctures were not formed at any of the polarities, and because none of the two flashovers allowed by the acceptance criterion of the standard for the positive polarity was present. The peak values for the full waves of lightning impulses applied are shown in the following Table.

| 0 m.s.n.m POLARITY | |
|---|---|
| kv (+) | kv (−) |
| 44.34954 | −46.53933 |
| 45.40668 | −45.98559 |
| 46.79103 | −46.01076 |
| 44.85294 | −46.02335 |
| 45.16757 | −46.27505 |
| 45.1424 | −46.27505 |
| 45.1424 | −45.41927 |
| 45.68355 | −46.22471 |
| 45.69614 | −45.6458 |
| 45.68355 | −45.92267 |
| 46.50158 | −46.21212 |
| 46.52675 | −45.8975 |
| 45.3941 | −45.92267 |
| 45.43185 | −45.40668 |
| 45.97301 | −45.41927 |
| 45.58287 | −45.94532 |

EXAMPLE 2

Lightning Impulse Critical Flashover Voltage Test

For the Lightning Impulse Critical Flashover Voltage test, the Step Up and Down method is followed. This method consists in a previous application of a series of lightning impulses until a flashover is achieved in the bushing. From that point onwards, the following lightning impulses with positive polarity are counted until thirty of them are accumulated. Then, thirty lightning impulses with negative polarity are applied. The level of the lightning impulses is adjusted at every step by following a criterion based on the appearance or absence of flashovers in the bushing. If a flashover does not occur in the bushing as a consequence of the application of a lightning impulse, for the application of the following lightning impulse the voltage is increased in a value not higher than 5% with respect to the expected Lightning Impulse Critical Flashover Voltage. On the contrary, if a flashover occurs in the bushing, the voltage is decreased in a value equal to 5% of the expected Lightning Impulse Critical Flashover Voltage. At the end of the application of the thirty lightning impulses for both positive and negative polarities, a Lightning Impulse Critical Flashover Voltage is reported for each one of the polarities, which corresponds to the voltage producing 50% of the flashovers during the test. The results obtained from the Lightning Impulse Critical Flashover Voltage tests carried out, are shown in the following Table.

TABLE 2

| POLARITY | | | |
|---|---|---|---|
| kv (+) | | kv (−) | |
| 43 | x | −54 | x |
| 40 | o | −52 | o |
| 43 | o | −54 | x |
| 46 | x | −52 | x |
| 43 | o | −49 | o |
| 45 | o | −51 | o |
| 46 | x | −53 | x |
| 45 | x | −51 | o |
| 43 | o | −54 | x |
| 45 | x | −52 | o |
| 43 | o | −54 | o |
| 45 | x | −56 | x |
| 43 | o | −54 | o |
| 45 | o | −57 | x |
| 46 | x | −54 | x |
| 45 | x | −52 | o |
| 43 | o | −54 | o |
| 45 | o | −56 | x |
| 47 | x | −54 | x |
| 45 | o | −52 | x |
| 47 | x | −50 | o |
| 46 | x | −52 | o |
| 43 | o | −54 | x |
| 45 | x | −52 | x |
| 43 | o | −50 | o |
| 45 | x | −52 | x |
| 43 | o | −50 | o |
| 45 | x | −52 | x |
| 47 | x | −50 | o |
| 45 | o | −52 | o |

CFO KV
(+) = 45 KV
(−) = 53 KV
o withstand
x flashover

What is claimed is:

1. A porcelain bushing for transformers withstanding impulse voltages rated at 45 kV and 1.2/50 μs without external flashover or puncture, having a creepage to arcing distance ratio from 1.05 to 1.24, comprising;

a body comprised of a flange fitted with a gasket seat groove, a neck having a curvature radius ranging from 5 to 7 mm and a mouth equipped with a two-level stepped gasket seat; and a threaded shank for attachment of said body to a mounting surface.

2. A porcelain bushing as described in claim 1 wherein the joints formed between the neck and both mouth and flange has a minimum curvature radius of 1.5 mm.

3. A porcelain bushing as described in claim 1 wherein the mouth is fitted with a semicircular groove whose functions are to orientate metallic connector at the moment of its assembly with the porcelain bushing, avoiding the rotation of said metallic connector when a torsion pair is applied during attachment of the porcelain bushing to the mounting surface.

4. A porcelain bushing as described in claim 1 wherein a groove rail extends along the shank's thread, acting as a directional guide for the porcelain bushing at the moment of its assembly, avoiding the rotation of the porcelain bushing during its attachment to the mounting surface.

5. A porcelain bushing as described in claim 1 wherein saidbody is coated with glassy enamel in order to protect against contamination by external agents as well as against absorption of water.

* * * * *